US006438773B1

(12) United States Patent
Hsia

(10) Patent No.: US 6,438,773 B1
(45) Date of Patent: Aug. 27, 2002

(54) COLLAPSIBLE FRAME STRUCTURE FOR PEN AND COT

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 09/930,825

(22) Filed: Aug. 14, 2001

(51) Int. Cl.[7] ..... A47D 7/00
(52) U.S. Cl. ..... 5/99.1; 5/98.1
(58) Field of Search ..... 5/93.1, 98.1, 98.3, 5/99.1

(56) References Cited

U.S. PATENT DOCUMENTS 2,974,325 A * 3/1961 Mango ..... 5/94
3,430,273 A * 3/1969 Stillwaugh ..... 5/114
4,186,454 A * 2/1980 Cone ..... 5/99.1
4,202,065 A * 5/1980 Sullivan ..... 5/99.1
4,376,318 A * 3/1983 Cirillo ..... 5/114
6,185,762 B1 * 2/2001 Homeyer ..... 5/93.1

* cited by examiner

*Primary Examiner*—Michael F. Trettel
(74) *Attorney, Agent, or Firm*—Raymond Y. Chan; David and Raymond Patent Group

(57) ABSTRACT

A collapsible frame structure for supporting a fabric made boundary shelter to form a pen or cot, wherein the collapsible frame structure includes two pairs of first frame legs and two pairs of second frame legs. Four upper frame joints and four lower frame joints are pivotally connected the first frame legs with the second frame legs respectively to form a box structure that defines an interior cavity within the first and second frame legs. The boundary shelter is suspendedly disposed in the interior cavity and includes four side sheets having four top edge portions and a bottom sheet extended from the side sheets edge to edge wherein each top edge portions of the side sheets are overlappedly folded to form a U-shaped cross sectional structure to define a support chamber for receiving the respective upper frame therein, so as to support said boundary shelter on said collapsible frame.

24 Claims, 7 Drawing Sheets

COLLAPSIBLE FRAME STRUCTURE FOR PEN AND COT

BACKGROUND OF THE PRESENT INVENTION

1. Field of Invention

The present invention relates to pens and cots, and more particularly to a collapsible frame structure for pen and cot which is facilitated to be folded into a compact unit for storage and carriage.

2. Description of Related Arts

Pen and cot are used to restrict the movement of a baby or a young child who is able to crawl or walk when the parents cannot always keep their eyes on their babies. Especially during outdoor activities such as a picnic, it is unreasonable to let the baby crawl around the strange and dangerous place. However, it is also impossible for the parents to carry a pen or cot everywhere.

In order to save space for traveling and storage, most of the pens and cots are made foldable to reduce their sizes. Traditional foldable pen or cot comprises a foldable frame comprising a plurality of joints pivotally connecting with a plurality of supporting rods respectively to form an open box structure, so that a baby can be put within a cloth made boundary to restrict his or her movement. It is reported that babies may be hurted or even killed accidentally due to the unwanted folding up of the pen or cot.

Moreover, any structure that can be folded won't have a rigid structure due to the clearance existing in those foldable joints that causes otheradverse effects like rocking and shaking. In other words, the conventional pen/cot fails to provide an absolutely safe environment for the babies.

Since the conventional foldable pen/cot contains too many joints it not only unreasonably increases its manufacturing cost but also causes construction weakness at those joints. Most foldable pens or cots break at such weakened joint structures that make the products being not durable enough.

It is unreasonable to place your baby in a risky or unsafe enviornment. However, we have to tolerate the above mentioned drawbacks until an improved innovative pen/cot structure is developed to provide an absolutely safe boundary for the babies while it can quickly reduce its size when it is not used in order to save the travel or storage space.

SUMMARY OF THE PRESENT INVENTION

A main object of the present invention is to provide a collapsible frame structure for pen and cot which can provide a rigid frame structure for preventing the pen or cot from rocking and shaking and any unwanted collapse.

Another object of the present invention is to provide a collapsible frame structure for pen and cot, which is facilitated to be folded into a compact unit for storage and carriage.

Another object of the present invention is to provide a collapsible frame structure for pen and cot, wherein the weight of the baby applied on the pen or cot will further ensure the construction of the collapsible frame so as to prevent the collapsible frame from being folded up accidentally.

Another object of the present invention is to provide a collapsible frame structure for pen and cot, which has a simple construction that every individual is able to fold and unfold the pen or cot by a single motion.

Accordingly, in order to accomplish the above objects, the present invention provides a collapsible frame structure for supporting a fabric made boundary shelter to form a pen or cot, wherein the collapsible frame structure comprises:

- two pairs of first frame legs pivotally connected with each other in a cross manner to form a pivotal "X" structure;
- two pairs of second frame legs pivotally connected with each other in a cross manner to from a pivotal "X" structure, wherein the two pairs of first frame legs are perpendicularly connecting to the two pairs of second frame legs respectively to form a box structure that defines an interior cavity therein;
- four upper frame joints for pivotally connecting four upper ends of the first frame legs with four upper ends of the second frame legs respectively; and
- four lower frame joints, each of which positioning under one of the upper frame joints, for pivotally connecting four lower ends of the first frame legs with four lower ends of the second frame legs respectively;
- whereby the boundary shelter is suspended in the interior cavity by overlappingly supporting four top edge portions of the boundary shelter on the four upper frames respectively.

DETAILED DESCRIPTION OF THE PREFERRED EMBODIMENT

Figure 1:
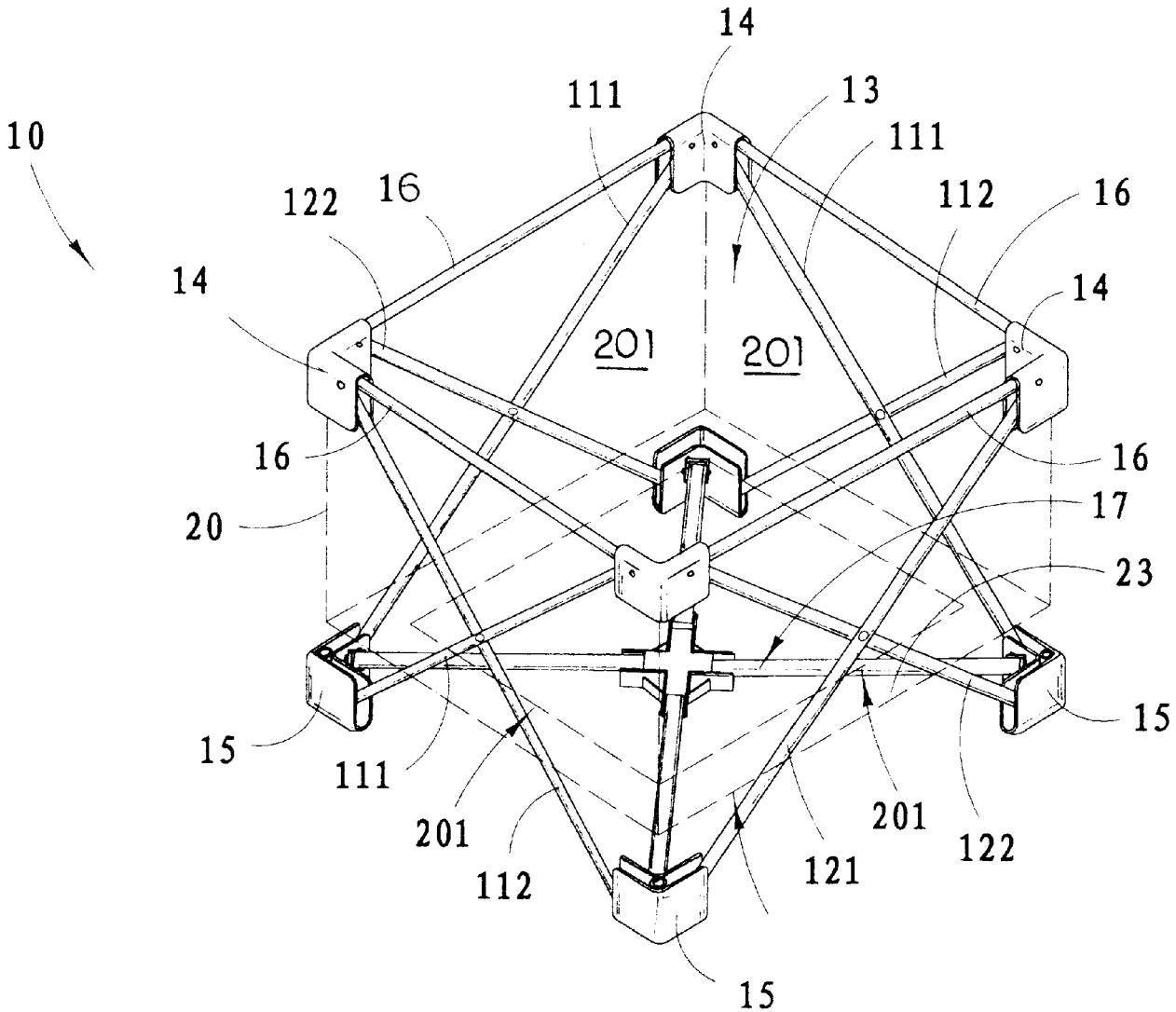
FIG. 1 is a perspective view of a collapsible frame structure for pen and cot according to a first preferred embodiment of the present invention.

Referring to FIG. 1 of the drawings, a collapsible frame structure 10 for supporting a fabric made boundary shelter 20 to form a pen or cot according to a first preferred embodiment of the present invention is illustrated. The collapsible frame structure 10 comprises two pairs of first frame legs 111, 112 pivotally connected with each other in a cross manner to form a pivotal "X" structure and two pairs of second frame legs 121, 122 pivotally connected with each other in a cross manner to from a pivotal "X" structure.

The collapsible frame structure 10 further comprises four upper frame joints 14 to pivotally connect four upper ends of the first frame legs 111, 112 with four upper ends of the second frame legs 121, 122 respectively, and four lower frame joints 15, each of which is directly positioned under one of the upper frame joints 14, to pivotally connect four lower ends of the first frame legs 111, 112 with four lower ends of the second frame legs 121, 122 respectively.

The two pairs of first frame legs 111, 112 are perpendicularly connected to the two pairs of second frame legs 121, 122 respectively. When the four pairs of the first and second frame legs 111, 112, 121, 122 are unfolded, a rigid box structure is formed which defines an interior cavity 13 surrounding by the first frame legs 111, 112 and the and second frame legs 121, 122. In other words, the four upper frame joints 14 and the four lower frame joints 15 are positioned at the corners of the square box formed by the first frame legs 111, 112 and the second frame legs 121, 122.

The boundary shelter 20, having a box shape, is suspendedly disposed in the interior cavity 13 wherein four top edge portions 21 of the boundary shelter 20 are overlapped supported on the four upper frame joints 14 respectively. The boundary shelter 20 comprises four side sheets 201 to define the four top edge portions 21 thereof and a bottom sheet 202 extended from the side sheets 201 in an edge to edge manner. Thus, a reinforcing cushion panel 23, having a size slightly smaller than the bottom sheet 202, can be disposed on the bottom sheet 202 so as to reinforce the shape of the boundary shelter 20 and to softly and comfortably support a user on the reinforcing cushion panel 23.

The collapsible frame structure 10 further comprises four fence units 16 each being detachably connected between two upper frame joints 14, wherein each of the fence units 16 comprises at least two tubular posts 161 detachably connected with each other and an elongated element 162, which has two ends extended between two upper frame joints 14, slidably passing through the tubular posts 161 so as to hold the tubular posts 161 in position.

Figure 2:
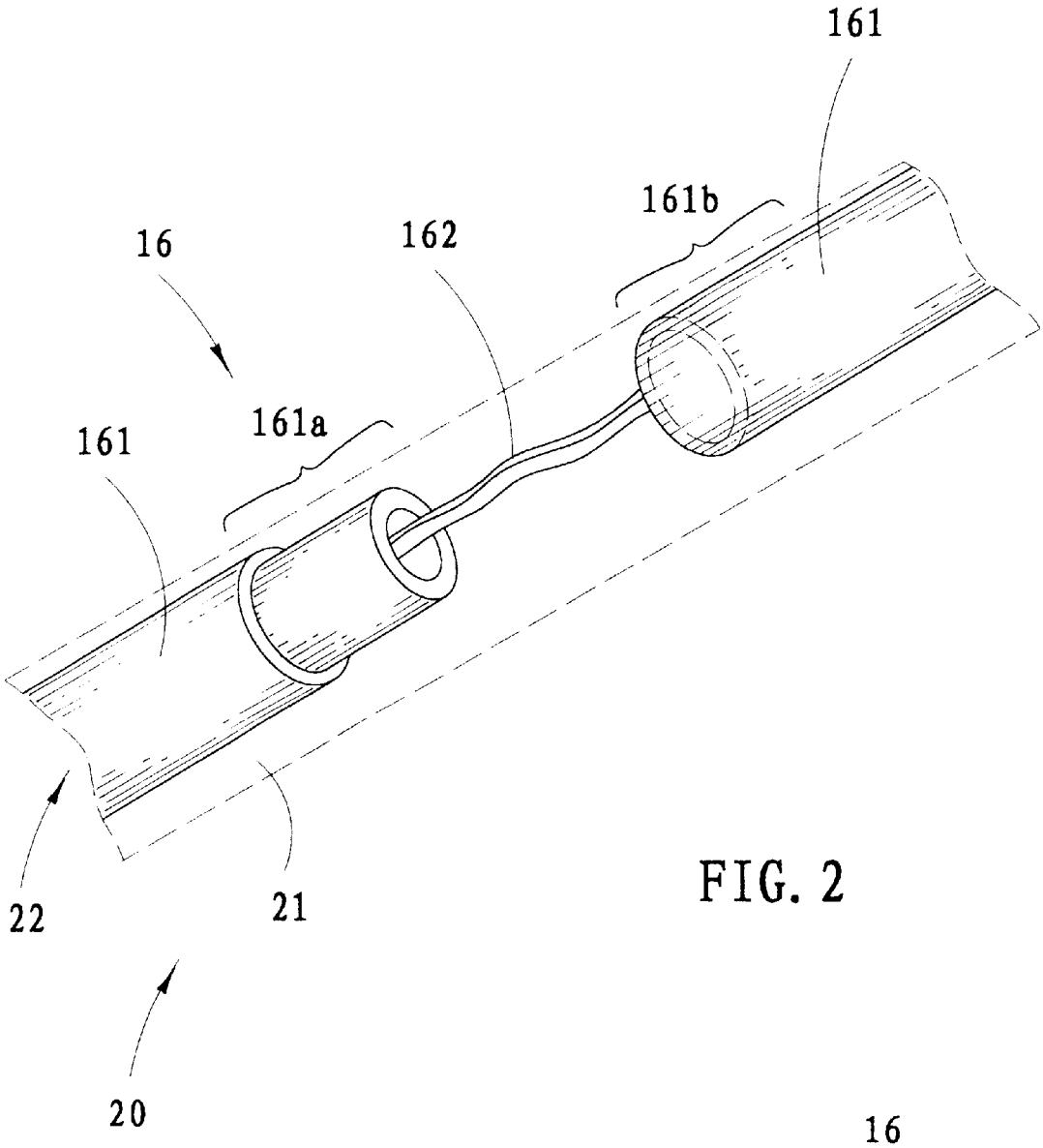
FIG. 2 is a perspective view of a fence unit of the collapsible frame structure for pen and cot according to the above first preferred embodiment of the present invention.

One of the tubular posts 161 has a connecting end portion 161*a* and the other adjacent tubular post 161 has a receiving end portion 161*b* having a diameter slightly larger than the connecting portion end 161*a*, such that the two tubular posts 161 are adapted for detachably connecting together by inserting the connecting end portion 161*a* of one of the tubular posts 161 into the receiving end portion 161*b* of the other tubular 161, as shown in FIG. 2.

Figure 7:
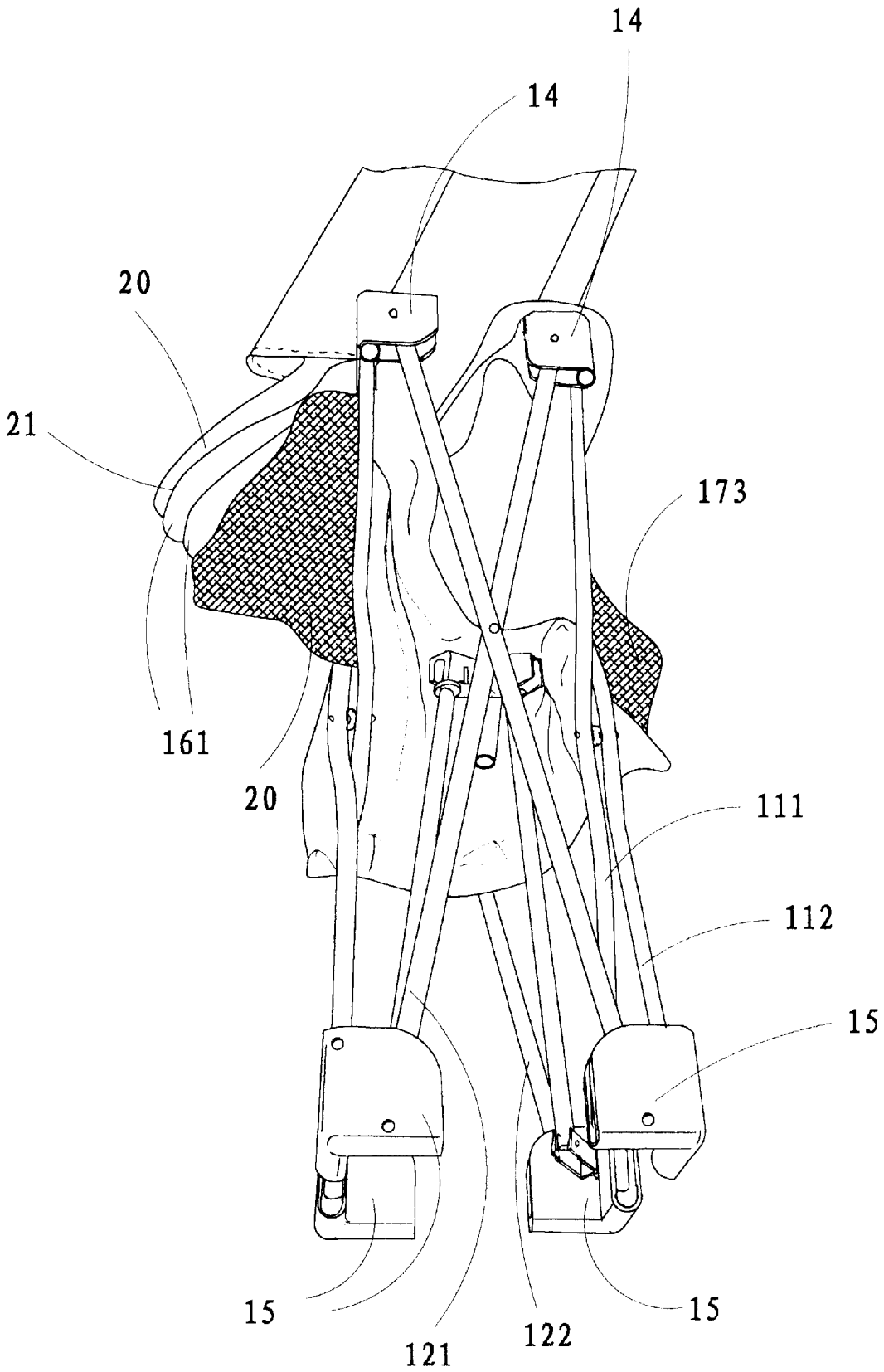
FIG. 7 is a perspective view of the collapsible frame structure for pen and cot in the folded state according to the above first preferred embodiment of the present invention.

The elongated element 162, which is a durable string, slidably passes through the tubular posts 161. Two ends of the elongated element 162 are attached to two adjacent upper frame joints 14 in such a manner that when the tubular posts 161 are detached from each other to fold up the collapsible frame structure 10 as shown in FIG. 7, the elongated element 162 holds the detached tubular posts 161 in position. So, the parents do not have to carry the tubular posts 161 and the collapsible frame structure 10 separately.

Alternatively, the four elongated elements 162 of the fence units 16 are integrally connected with each other to encircle the four upper frame joints 14. In other words, the elongated element 162, having a predetermined length, slidably passes through the four upper frame joints 14 and supports four sets of the tubular posts 161 at four sides of the collapsible frame structure 10 respectively.

Figure 3:
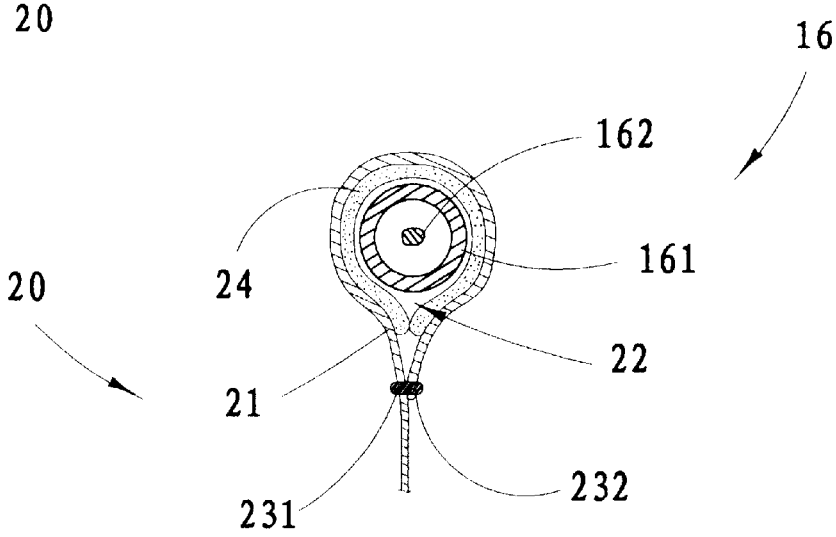
FIG. 3 is a sectional view of a boundary shelter of the collapsible frame structure for pen and cot according to the above first preferred embodiment of the present invention.

As shown in FIG. 3, the top edge portions 21 of the boundary shelter 20 is substantially supported by the fence units 161 respectively wherein each top edge portion 21 of the boundary shelter 20 is folded to form a U-shaped cross sectional structure to define a support chamber 22 for receiving the fence unit 16 therein.

A set of first and second fastening units 231, 232, which is a pair of snap fasteners, is spacedly provided on two inner sides of the support chamber 22 for enclosing the support chamber 22 so as to firmly mount the boundary shelter on the collapsible frame structure 10. It is apparent that the snap fasteners 231, 232 can be replaced by other fastening units such as hook and loop fasteners respectively. Moreover, a rubber or foaming made cushion pad 24 is preferred to be enclosed in the support chamber 22 to provide a soft and comfort top edge portion 21 of the boundary shelter 20, so as to prevent a baby in the boundary shelter 20 from being hurted by the fence unit 16.

Figure 4:
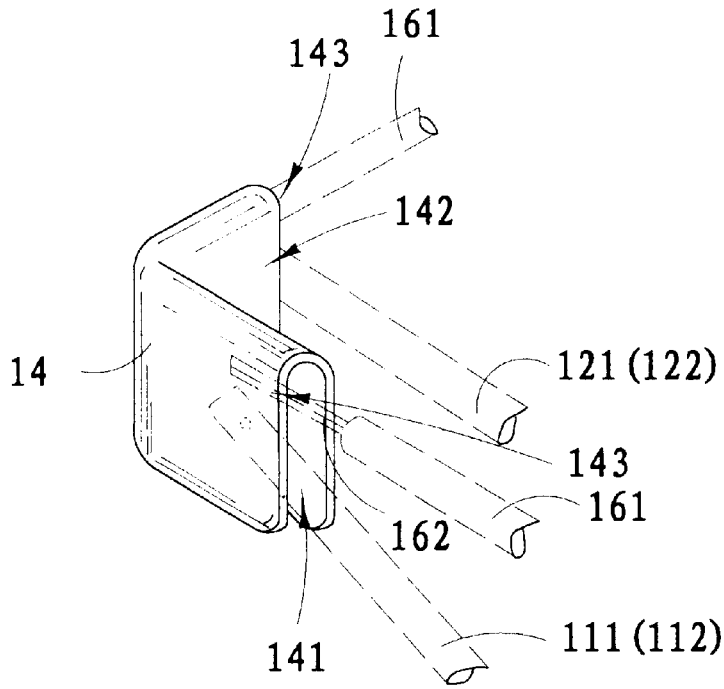
FIG. 4 is a perspective view of an upper frame joint of the collapsible frame structure for pen and cot according to the above first preferred embodiment of the present invention.

As shown in FIG. 4, each of the L-shaped upper frame joints 14, having a U-shaped cross section, has a first pivot channel 141 and a second pivot channel 142 for pivotally connecting with the respective first frame leg 111, 112 and the respective second frame leg 121, 122 respectively, and two transverse guiding channels 143 each for the connecting end portion 161 a of the tubular post 161 fittedly inserting thereinto, so as to lock up the fence unit 16 on the upper frame joint 14. In other words, a downward force applied by the user's weight can be evenly distributed to the entire collapsible frame structure 10 so as to minimize a stress around the upper frame joints 14.

Figure 5:
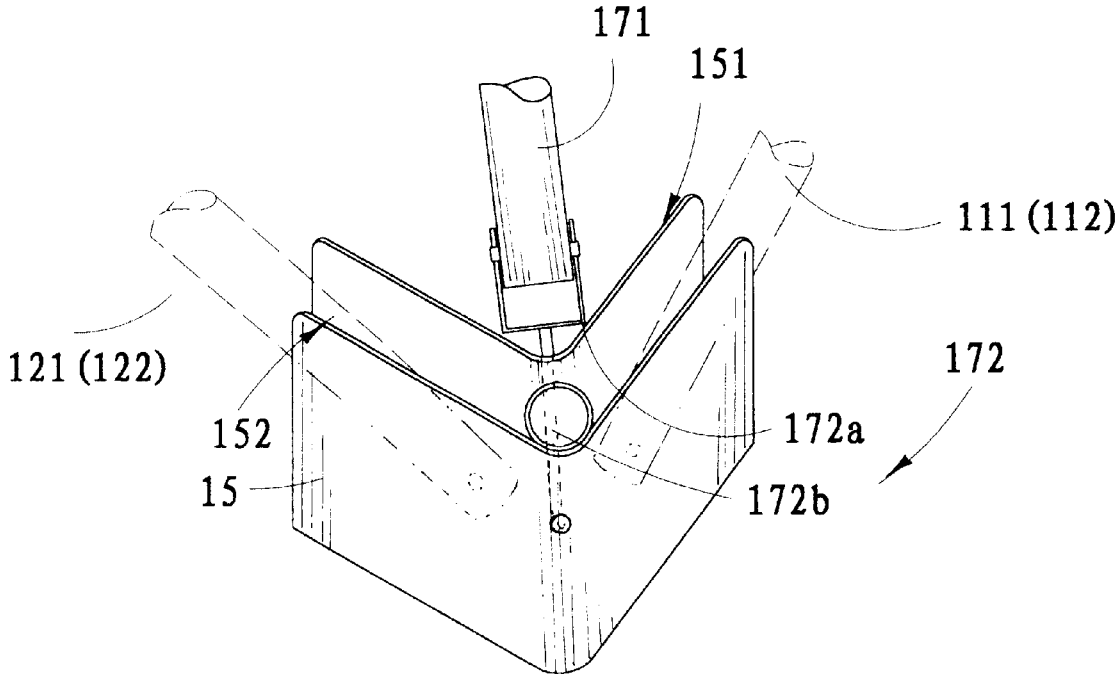
FIG. 5 is a perspective view of a lower frame joint of the collapsible frame structure for pen and cot according to the above first preferred embodiment of the present invention.

A shown in FIG. 5, each of the L-shaped lower frame joints 15, having a U-shaped cross section, has a first pivot slot 151 and a second pivot slot 152 pivotally connecting with the respective first frame leg 111, 112 and the respective second frame leg 121, 122 respectively.

Figure 6:
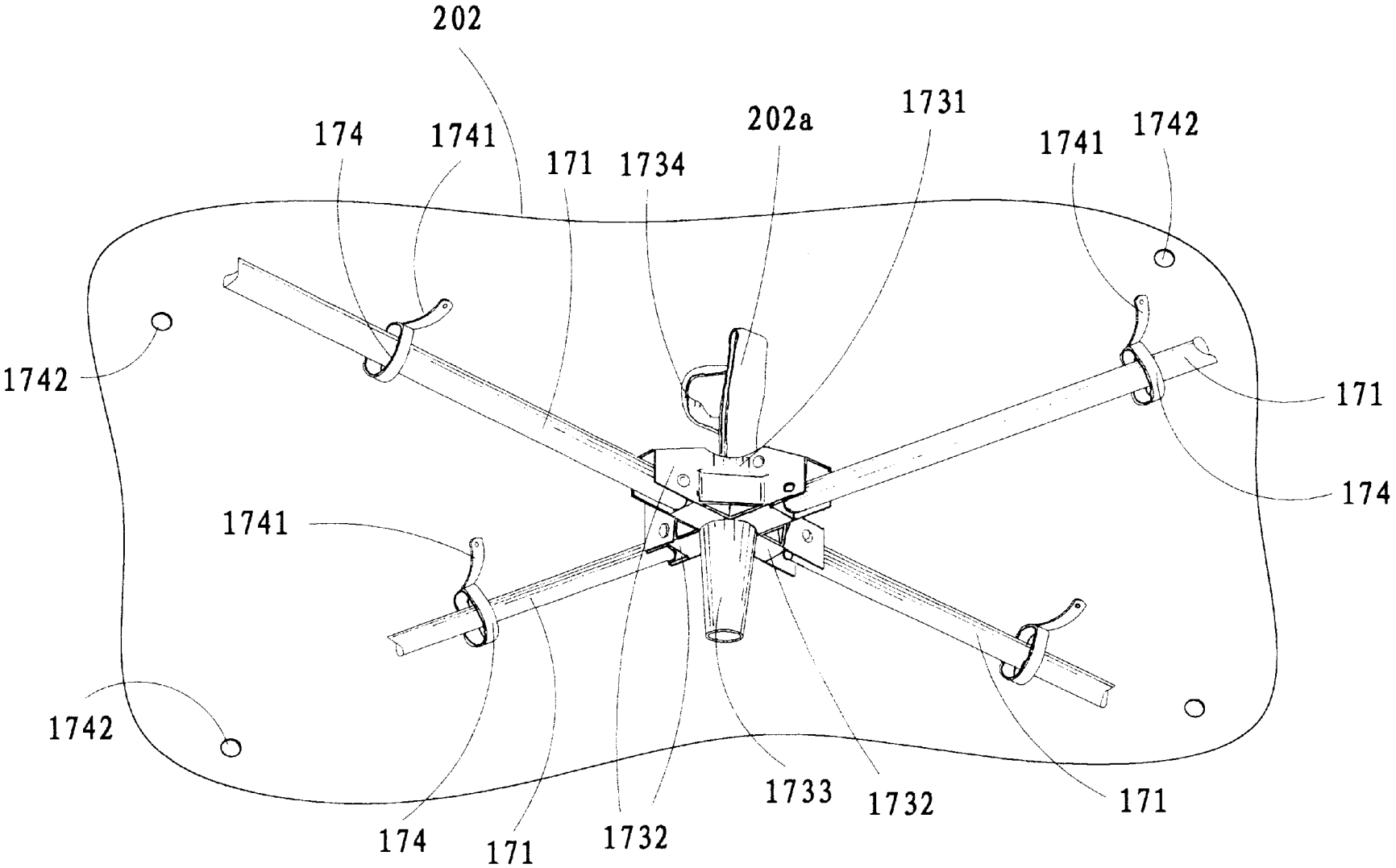
FIG. 6 is a perspective view of a base frame of the collapsible frame structure for pen and cot according to the above first preferred embodiment of the present invention.

As shown in FIG. 6, the collapsible frame structure 10 further comprises a base frame 17 comprising four base frame legs 171, four base joints 172 attached to the four lower frame joints 15 for pivotally connecting four outer ends of the four base frame legs 171 respectively, and a coupling joint 173 for pivotally connecting four inner ends of the four base frame legs 171 respectively, so as to diagonally connect to the lower frame joints 15.

Each of the base joints 172 has a U-shaped head portion 172*a* pivotally connected to the respective base frame leg 171 and an elongated tail portion 172*b* penetrated through the respective lower frame joint 15, so as to substantially attach the base joint 172 to the lower frame joint 15.

The coupling joint 173 comprises a joint member 1731, four pairs of parallel pivot walls 1732 radially extended therefrom for pivotally connecting the four base frame leg 171 between each pair of pivot walls 1732, a central supporting post 1733 downwardly extended from the joint member 1731, and a handle strap 1734 attached on top of the joint member 1731.

Accordingly, the central supporting post 1733, having a predetermined height, is adapted for biasing against the floor when it is unfolded, as shown in FIG. 1, so as to further support the bottom sheet 202 of the boundary shelter 20.

The handle strap 1734, which is a durable belt, has one end attached to the top of the joint member 1731 and another free end upwardly penetrated through a though slit 202*a* provided on the bottom sheet 202 and arranged in such a manner that the handle strap 1734 is pulled upwardly to fold up the collapsible frame structure 10, as shown in FIG. 7.

The base frame 17 further comprises four sliding rings 174 slidably mounted on four base frame legs 171, wherein each of the sliding rings 174 has a first snap fastener 1741 adapted for detachably fastening to a second snap fastener 1742 provided on each corner of a bottom side of the bottom sheet 202, so as to reinforce and retain the shape of the bottom sheet 202 on the base frame 17. In other words, the base frame 17 is detachably attached to the bottom sheet at the four corners thereof to prevent the distortion of the boundary shelter 20.

Figure 8:
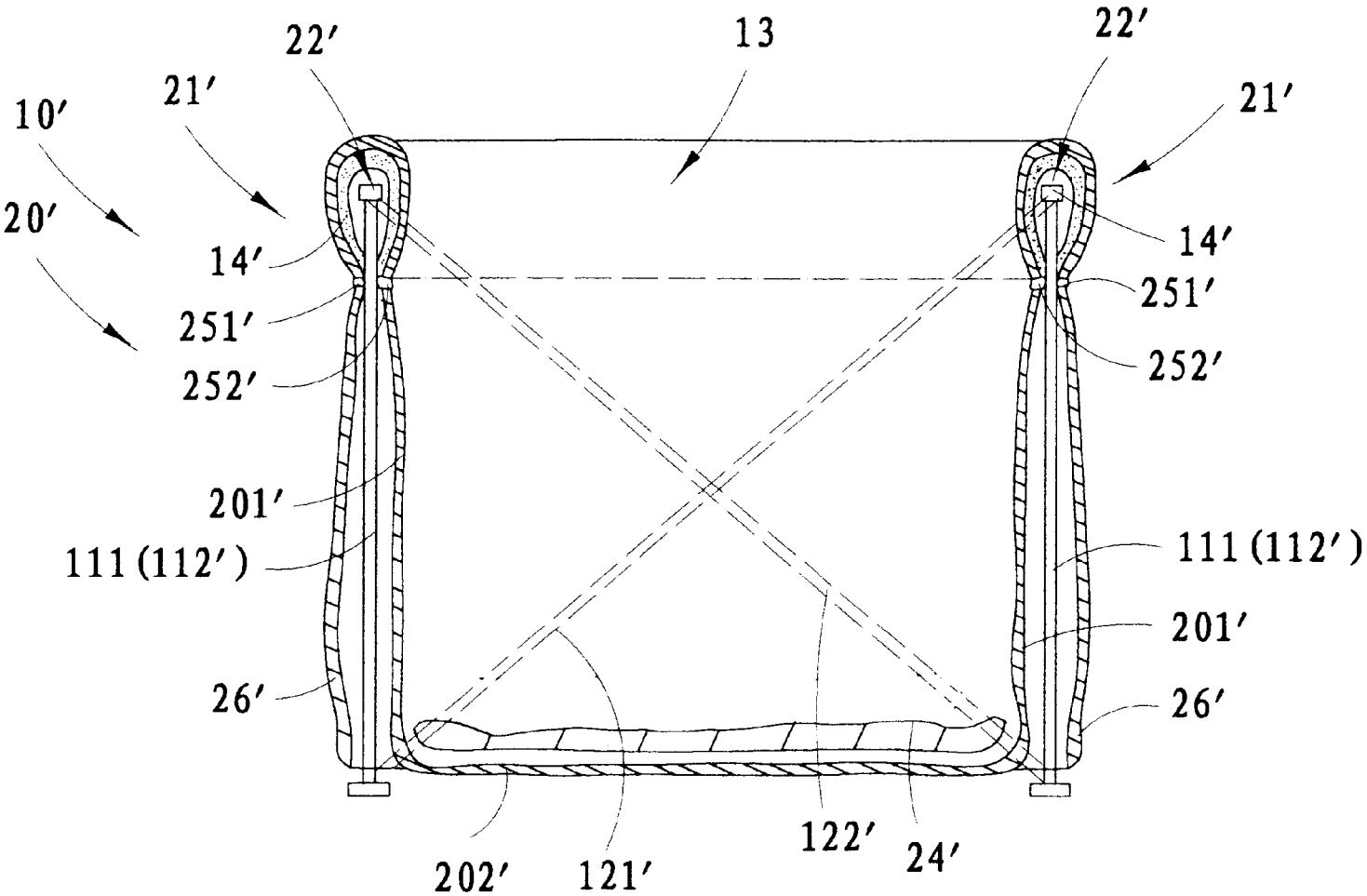
FIG. 8 is a sectional schematic view of a collapsible frame structure for pen and cot according to a second preferred embodiment of the present invention.

Referring to FIG. 8, a second embodiment of the present invention illustrates an alternative mode of the first embodiment of the pen and cot, wherein the second embodiment can further reduce the weight of the pen and cot for easy carriage and storage.

The collapsible frame structure 10' comprises two pairs of first frame legs 111', 112' pivotally connected with each other in cross manner to form a pivotal "X" structure and two pairs of second frame legs 121', 122' pivotally connected with each other in a cross manner to from a pivotal "X" structure.

The collapsible frame structure 10' further comprises four upper frame joints 14' for pivotally connecting four upper ends of the first frame legs 111', 112' with four upper ends of the second frame legs 121', 122' respectively, and four lower frame joints 15', each of which directly under one of the upper frame joints 14', for pivotally connecting four lower ends of the first frame legs 111', 112' with four lower ends of the second frame legs 121', 122' respectively.

The two pairs of first frame legs 111', 112' are perpendicularly connected to the two pairs of second frame legs 121', 122' respectively to form a rigid box structure which defines an interior cavity 13' surrounding by the first frame legs 111', 112' and the second frame legs 121', 122'.

The boundary shelter 20', having a box shaped, is suspendedly disposed in the interior cavity 13', wherein four top edge portions 21' of the boundary shelter 20' are overlapped supported on the four upper frames 14' respectively. The boundary shelter 20' comprises four side sheets 201' that define the four top edge portions 21' thereof and a bottom sheet 202' extended from the side sheets 201' in an edge to edge manner. Each top edge portion 21' of the boundary shelter 20' is folded to form a U-shaped cross sectional structure to define a support chamber 22'.

Thus, a reinforcing cushion panel 23', having a size slightly smaller than the bottom sheet 202', can be disposed on the bottom sheet 202' so as to reinforce the shape of the boundary shelter 20' and to softly and comfortably support a user on the reinforcing cushion panel 23'.

Figure 9:
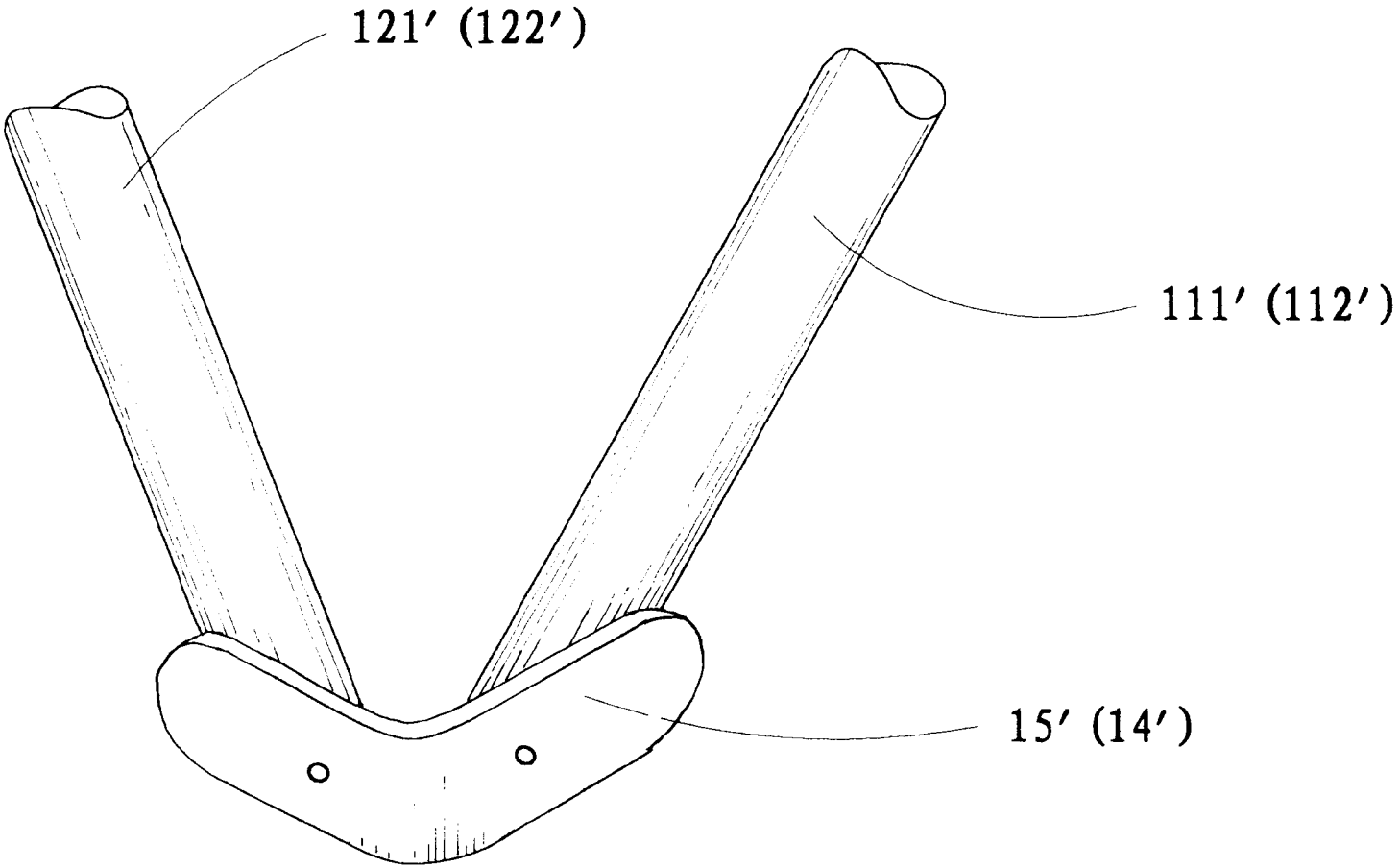
FIG. 9 is a perspective view of a lower frame joint of the collapsible frame structure for pen and cot according to the above second preferred embodiment of the present invention.

As shown in FIG. 9, each of the upper frame joints 14', which has the same structure of the lower frame joint 15' and a L-shaped, has two ends pivotally connected with the respective first frame leg 111', 112' and the respective second frame leg 121', 122' respectively.

Accordingly, the boundary shelter 20' further comprises four fabric made outer side panels 26' integrally extended from top edges of the four side sheets 201' respectively in such a manner that the first frame legs 111', 112' and the second frame legs 121', 122' are received between the side sheets 201' and the outer side panels 26'. In other words, the four outer side panels 26' encirclingly cover up four sides of the collapsible frame structure 10' so as to securely mount the boundary shelter 20' thereon.

In addition, a rubber or foaming made cushion pad 24' is preferred to be enclosed in each support chamber 22' to provide a soft and comfort top edge portion 21' of the boundary shelter 20'. At least a set of first and second snap fasteners 251', 252' is provided on two inner sides of the support chamber 22' for enclosing the support chamber 22' so as to firmly mount the boundary shelter 20' on the collapsible frame structure 10'.

What is claimed is:

1. A collapsible pen, comprising a collapsible frame which comprises:

two pairs of first frame legs pivotally connected with each other in a cross manner to form a pivotal "X" structure;

two pairs of second frame legs pivotally connected with each other in a cross manner to from a pivotal "X" structure, wherein said two pairs of first frame legs are perpendicularly connected with said two pairs of second frame legs respectively to form a box structure that defines an interior cavity surrounding by said first and second frame legs;

four upper frame joints pivotally connecting four upper ends of said first frame legs with four upper ends of said second frame legs respectively; and four lower frame joints, each of which is positioned under one of said upper frame joints, pivotally connecting four lower ends of said first frame legs with four lower ends of said second frame legs respectively; and a fabric made boundary shelter supported by said collapsible frame structure, wherein said boundary shelter is suspended in said interior cavity by overlappingly supporting four top edge portions of said boundary shelter on said four upper frame joints respectively.

2. The collapsible pen, as recited in claim 1, wherein said boundary shelter, which has a box shape and is suspendedly disposed in said interior cavity, comprises four side sheets having four top edge portions and a bottom sheet extended from said side sheets edge to edge, wherein each of said top edge portions of said side sheets is overlappedly folded to form a U-shaped cross sectional structure to define a support chamber.

3. The collapsible pen, as recited in claim 2, further comprising four fence units each of which is detachably connected between two of said upper frame joints, wherein said four fence are respectively received in said four support chambers of said side sheets therethrough so as to support said boundary shelter on said collapsible frame, wherein each said fence unit comprises at least a first tubular post and a second tubular post detachably connecting with each other and an elongated element slidably passing through said first and second tubular posts and having two ends extended between said two respective upper frame joints so as to hold said first and second tubular posts in position.

4. The collapsible pen, as recited in claim 3, wherein said first tubular post has a connecting end portion and said second tubular post has a receiving end portion having a diameter slightly larger than said connecting portion end, wherein said first and second tubular posts are capable of being detachably connected together by inserting said connecting end portion of said first tubular post into said receiving end portion of said second tubular post.

5. The collapsible pen, as recited in claim 3, wherein each of said upper frame joints, each having a L-shape and a U-shaped cross section, has a first and second pivot channels for pivotally connecting with two of said upper frame legs respectively, and two transverse guiding channels each for an end portion of said respective tubular post fittedly inserting thereinto, so as to lock up said respective fence unit on said upper frame joint.

6. The collapsible pen, as recited in claim 3, wherein said boundary shelter further comprises a set of first and second fastening units spacedly provided on two inner sides of said support chamber respectively for enclosing said supporting cavity so as to securely mount said boundary shelter on said collapsible frame.

7. The collapsible pen, as recited in claim 5, wherein said boundary shelter further comprises a set of first and second fastening units spacedly provided on two inner sides of said support chamber respectively for enclosing said supporting cavity so as to securely mount said boundary shelter on said collapsible frame.

8. The collapsible pen, as recited in claim 3, wherein each of said lower frame joints, having a L-shape and a U-shaped cross section, has a first pivot slot and a second pivot slot pivotally connecting with two of said lower frame legs respectively.

9. The collapsible pen, as recited in claim 7, wherein each of said lower frame joints, having a L-shape and a U-shaped cross section, has a first pivot slot and a second pivot slot pivotally connecting with two of said lower frame legs respectively.

10. The collapsible pen, as recited in claim 6, wherein said boundary shelter further comprises a cushion pad enclosed in each said support chamber to provide a soft and comfort top edge portion of said boundary shelter.

11. The collapsible pen, as recited in claim 9, wherein said boundary shelter further comprises a cushion pad enclosed in each said support chamber to provide a soft and comfort top edge portion of said boundary shelter.

12. The collapsible pen, as recited in claim 1, further comprising a base frame comprising four base frame legs, four base joints attached to said four lower frame joints pivotally connecting four outer ends of said four base frame legs respectively, and a coupling joint pivotally connecting four inner ends of said four base frame legs respectively, so as to diagonally connect to said lower frame joints.

13. The collapsible pen, as recited in claim 2, further comprising a base frame comprising four base frame legs, four base joints attached to said four lower frame joints pivotally connecting four outer ends of said four base frame legs respectively, and a coupling joint pivotally connecting four inner ends of said four base frame legs respectively, so as to diagonally connect to said lower frame joints.

14. The collapsible pen, as recited in claim 12, wherein said coupling joint comprises a joint member, four pairs of parallel pivot walls radially extended therefrom to pivotally connect said four base frame leg between each said pair of pivot walls, a central supporting post having a predetermined height downwardly extended from said joint member, and a handle strap having one end attached to a top of said joint member and another free end upwardly penetrated through a though slit provided on a bottom of said boundary shelter and arranged in such a manner that said handle strap is pulled upwardly to fold up said collapsible frame.

15. The collapsible pen, as recited in claim 13, wherein said coupling joint comprises a joint member, four pairs of parallel pivot walls radially extended therefrom for pivotally connecting said four base frame leg between each said pair of pivot walls, a central supporting post having a predetermined height downwardly extended from said joint member, and a handle strap having one end attached to a top of said joint member and another free end upwardly penetrated through a though slit provided on said bottom sheet and arranged in such a manner that said handle strap is pulled upwardly to fold up said collapsible frame.

16. The collapsible pen, as recited in claim 13, wherein said base frame further comprises four sliding rings slidably mounted on said four base frame legs wherein each of said sliding rings has a first snap fastener adapted for detachably fastening to a second snap fastener provided on each corner of a bottom side of said bottom sheet, so as to detachably attach said bottom sheet to said base frame.

17. The collapsible pen, as recited in claim 14, wherein said base frame further comprises four sliding rings slidably mounted on said four base frame legs wherein each of said sliding rings has a first snap fastener adapted for detachably fastening to a second snap fastener provided on each corner of a bottom side of said bottom sheet, so as to detachably attach said bottom sheet to said base frame.

18. The collapsible pen, as recited in claim 15, wherein said base frame further comprises four sliding rings slidably mounted on said four base frame legs wherein each of said sliding rings has a first snap fastener adapted for detachably fastening to a second snap fastener provided on each corner of a bottom side of said bottom sheet, so as to detachably attach a bottom of said boundary shelter to said base frame.

19. The collapsible pen, as recited in claim 3, further comprising a base frame comprising four base frame legs, four base joints attached to said four lower frame joints for pivotally connecting four outer ends of said four base frame legs respectively, and a coupling joint pivotally connecting four inner ends of said four base frame legs respectively, so as to diagonally connect to said lower frame joints.

20. The collapsible pen, as recited in claim 19, wherein said coupling joint comprises a joint member, four pairs of parallel pivot walls radially extended therefrom for pivotally connecting said four base frame leg between each said pair of pivot walls, a central supporting post having a predetermined height downwardly extended from said joint member, and a handle strap having one end attached to a top of said joint member and another free end upwardly penetrated through a though slit provided on said bottom sheet and arranged in such a manner that said handle strap is pulled upwardly to fold up said collapsible frame.

21. The collapsible pen, as recited in claim 20, wherein said base frame further comprises four sliding rings slidably mounted on said four base frame legs wherein each of said sliding rings has a first snap fastener adapted for detachably fastening to a second snap fastener provided on each corner of a bottom side of said bottom sheet, so as to detachably attach said bottom sheet to said base frame.

22. The collapsible pen, as recited in claim 2, wherein said boundary shelter further comprises four fabric made outer side panels integrally extended from top edges of said four side sheets respectively in such a manner that said first frame legs and said second frame legs are received between said side sheets and said outer side panels.

23. The collapsible pen, as recited in claim 22, wherein said boundary shelter further comprises at least a set of first and second snap fasteners provided on two inner sides of said support chamber for enclosing said support chamber so as to firmly mount said boundary shelter on said collapsible frame.

24. The collapsible pen, as recited in claim 23, wherein said boundary shelter further comprises a cushion pad enclosed in each said support chamber to provide a soft and comfort top edge portion of said boundary shelter.

* * * * *